US009022538B2

(12) United States Patent
Komaba et al.

(10) Patent No.: US 9,022,538 B2
(45) Date of Patent: May 5, 2015

(54) IMAGE FORMING APPARATUS AND TREATMENT-LIQUID APPLICATION DEVICE

(75) Inventors: Hiroyoshi Komaba, Kanagawa (JP); Shinji Imoto, Tokyo (JP); Satoshi Kitaoka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 54 days.

(21) Appl. No.: 13/158,767

(22) Filed: Jun. 13, 2011

(65) Prior Publication Data

US 2011/0310185 A1 Dec. 22, 2011

(30) Foreign Application Priority Data

Jun. 16, 2010 (JP) ..... 2010-136784

(51) Int. Cl.
*B41J 2/175* (2006.01)
*B41J 11/00* (2006.01)

(52) U.S. Cl.
CPC ..... *B41J 2/175* (2013.01); *B41J 2/17596* (2013.01); *B41J 11/0015* (2013.01)

(58) Field of Classification Search
CPC ..... B41J 2/175
See application file for complete search history.

(56) References Cited

U.S. PATENT DOCUMENTS

| | | | | |
|---|---|---|---|---|
| 7,334,858 | B2 | 2/2008 | Kogure et al. | |
| 7,434,927 | B2 | 10/2008 | Sakmua et al. | |
| 7,591,545 | B2 * | 9/2009 | Iwasaki et al. | 347/84 |
| 7,591,551 | B2 | 9/2009 | Imoto et al. | |
| 7,621,632 | B2 | 11/2009 | Imoto et al. | |
| 7,682,016 | B2 | 3/2010 | Sakuma et al. | |
| 7,731,322 | B2 | 6/2010 | Kogure et al. | |
| 7,891,805 | B2 | 2/2011 | Imoto et al. | |
| 8,333,464 | B2 * | 12/2012 | Hirato | 347/96 |
| 2005/0200666 | A1 * | 9/2005 | Iwasaki et al. | 347/84 |
| 2006/0214958 | A1 * | 9/2006 | Inoue | 347/5 |
| 2007/0064077 | A1 * | 3/2007 | Konno | 347/102 |

(Continued)

FOREIGN PATENT DOCUMENTS

| | | |
|---|---|---|
| JP | 10-230201 | 9/1998 |
| JP | 2003-205673 | 7/2003 |

(Continued)

OTHER PUBLICATIONS

U.S. Appl. No. 13/045,809, filed Mar. 11, 2011.

*Primary Examiner* — Matthew Luu
*Assistant Examiner* — Lily Kemathe
(74) *Attorney, Agent, or Firm* — Cooper & Dunham LLP

(57) ABSTRACT

An image forming apparatus includes a treatment-liquid application unit applying a treatment liquid from a chamber to a recording medium; a treatment-liquid storage unit to store the liquid; a supply channel member forming a supply channel to supply the liquid from the treatment-liquid storage unit to the chamber; a collection channel member forming a collection channel to collect the liquid from the chamber; and a temporary storage portion disposed in the collection channel to temporarily store the liquid. The temporary storage portion has an internal horizontal cross-sectional area greater than a channel cross-sectional area of the collection channel. The collection channel member has a first channel portion of a channel cross-sectional area smaller than the internal horizontal cross-sectional area of the temporary storage portion. A liquid level of the liquid in the collection channel is maintained in the first channel portion after termination of collecting operation.

13 Claims, 6 Drawing Sheets

(56) References Cited

U.S. PATENT DOCUMENTS

| | | | | |
|---|---|---|---|---|
| 2008/0145123 | A1 | 6/2008 | Kogure et al. | |
| 2008/0223290 | A1* | 9/2008 | Iwasaki et al. | 118/46 |
| 2009/0052917 | A1 | 2/2009 | Kogure et al. | |
| 2009/0073211 | A1 | 3/2009 | Imoto | |
| 2009/0074461 | A1 | 3/2009 | Imoto | |
| 2009/0102908 | A1 | 4/2009 | Imoto | |
| 2009/0151625 | A1 | 6/2009 | Matsumoto et al. | |
| 2009/0231405 | A1* | 9/2009 | Fukui | 347/102 |
| 2010/0060688 | A1* | 3/2010 | Hirato | 347/14 |
| 2010/0245420 | A1 | 9/2010 | Ichimura et al. | |
| 2010/0245460 | A1* | 9/2010 | Imoto et al. | 347/20 |
| 2011/0057988 | A1* | 3/2011 | Izumikawa et al. | 347/21 |

FOREIGN PATENT DOCUMENTS

| | | | | |
|---|---|---|---|---|
| JP | 2005-138502 | | 6/2005 | |
| JP | 2008-168283 | | 7/2008 | |
| JP | 4223183 | | 11/2008 | |
| JP | 2009-12394 | | 1/2009 | |
| JP | 2009160925 | A * | 7/2009 | |
| WO | WO 2009142252 | A1 * | 11/2009 | B41J 11/00 |

* cited by examiner

IMAGE FORMING APPARATUS AND TREATMENT-LIQUID APPLICATION DEVICE

CROSS-REFERENCE TO RELATED APPLICATIONS

The present patent application claims priority pursuant to 35 U.S.C. §119 from Japanese Patent Application No. 2010-136784, filed on Jun. 16, 2010 in the Japan Patent Office, which is hereby incorporated herein by reference in its entirety.

BACKGROUND

1. Technical Field

This disclosure relates to an image forming apparatus and a treatment-liquid application device, and more specifically to an image forming apparatus capable of applying treatment liquid to an image recording medium and a treatment-liquid application device to apply treatment liquid to a modification target, for example, an image recording medium.

2. Description of the Background Art

Image forming apparatuses are used as printers, facsimile machines, copiers, plotters, or multi-functional devices having two or more of the foregoing capabilities. As one type of image forming apparatuses, for example, liquid-ejection-type image forming apparatuses are known that use a recording head(s) for ejecting droplets of ink or other liquid. During image formation, such liquid-ejection-type image forming apparatuses eject droplets of ink or other liquid from the recording head onto a recording medium to form a desired image.

Such inkjet-type image forming apparatuses fall into two main types: a serial-type image forming apparatus that forms an image by ejecting droplets from the recording head while moving the recording head in a main scanning direction of the carriage, and a line-head-type image forming apparatus that forms an image by ejecting droplets from a linear-shaped recording head held stationary in the image forming apparatus.

Such a liquid-ejection-type image forming apparatus may have image failures, such as "feathering" in which dots formed with liquid droplets blur in an jaggy shape on the recording medium and "color bleeding" in which different types of liquid droplets (e.g., ink droplets having different colors) mix each other at their adjacent areas. Alternatively, such a liquid-ejection-type image forming apparatus may take a relatively long time to dry liquid droplets on a recording medium after image formation.

To cope with such failures, a treatment liquid may be applied onto the recording medium before image formation to minimize failures, such as feathering or bleeding of droplets landed on the recording medium and reduce the time for drying droplets on the recording medium.

A conventional image forming apparatus includes a treatment-liquid container (treatment-liquid storage unit) to store a treatment liquid and a treatment-liquid application unit to apply the treatment liquid to a recording medium. The treatment liquid stored in the treatment-liquid container is replenish to a chamber of the treatment-liquid application unit through a supply channel. For the image forming apparatus, the chamber is opened to ambient air, and when application of the treatment liquid to the recording medium is not performed, the treatment liquid in the chamber evaporates from the surface of the treatment liquid. As a result, the treatment liquid may be wasted or change its properties due to change in concentration. In particular, when a highly-volatile liquid is used as the treatment liquid, such failures may become prominent.

To cope with such failures, for example, a conventional image forming apparatus retains treatment liquid in a liquid retaining space (chamber) between an application roller and a liquid retaining member and uses the application roller to apply the treatment liquid to the recording medium. The conventional image forming apparatus also includes a supply channel to supply the treatment liquid from a replacement tank (treatment-liquid storage unit) to the liquid retaining space via a buffer tank (temporary storage unit) and a collection channel to collect the treatment liquid from the liquid retaining space to the buffer tank when the application roller is stopped, to prevent or minimize leakage of the treatment liquid from the liquid retaining space. For such a configuration, when the application roller is stopped (application of the treatment liquid is not performed), the liquid level of treatment liquid is positioned within the buffer tank, not the liquid retaining space. The liquid retaining space is directly exposed to ambient air. By contrast, the buffer tank is exposed to ambient air only through the narrow collection channel connected to the liquid retaining space. The channel cross-sectional area of the collection channel is smaller than an area of the liquid level obtained when the liquid retaining space includes the treatment liquid. When the treatment liquid in the liquid retaining space is collected so as to position the liquid level of the treatment liquid within the buffer tank, the evaporation amount of the treatment liquid becomes smaller than in a case in which the treatment liquid is left in the liquid retaining space.

However, for such a configuration, the liquid level of the treatment liquid collected in the buffer tank has an area corresponding to a horizontal cross-sectional area of the buffer tank and contacts ambient air over a relatively large area. Thus, since the treatment liquid evaporates in the buffer tank, the treatment liquid is wasted and change characteristics due to, for example, a change in the concentration.

Alternatively, it is conceivable that a temporary storage unit, such as the buffer tank, is not provided in the collection channel. However, when the treatment liquid is collected from the liquid retaining space, air is also collected along with the treatment liquid. Unless air is removed from the collected treatment liquid, the treatment liquid is resupplied to the liquid retaining space in a foam. As a result, proper resupply of the treatment liquid to the liquid retaining space may be hampered, and the resupply itself may be hampered depending on the structure. Therefore, in a case in which the treatment liquid collected through the collection channel is resupplied, such a temporary storage unit as the buffer tank need be disposed in the collection channel to temporarily store the treatment liquid and separate air from the treatment liquid, thus causing the above-described failures.

In addition, the above-described failures may occur in not only the liquid-ejection-type image forming apparatus but also an apparatus including a treatment-liquid application device to apply a treatment liquid to an application target.

BRIEF SUMMARY

In an aspect of this disclosure, there is provided an improved image forming apparatus for forming an image on a recording medium. The image forming apparatus includes a treatment-liquid application unit including a chamber to store a treatment liquid and applying the treatment liquid from the chamber to a recording medium; a treatment-liquid storage unit to store the treatment liquid to be supplied to the chamber; a supply channel member forming a supply channel to supply the treatment liquid from the treatment-liquid storage unit to the chamber; a collection channel member forming a collection channel to collect the treatment liquid from the chamber; and a temporary storage portion disposed in the collection channel to temporarily store the treatment liquid collected through the collection channel member and resupplied to the chamber. The temporary storage portion has an internal horizontal cross-sectional area greater than a channel cross-sectional area of the collection channel. The collection channel member has a first channel portion of a channel cross-sectional area smaller than the internal horizontal cross-sectional area of the temporary storage portion. A liquid level of the treatment liquid in the collection channel is maintained in the first channel portion after termination of a collecting operation for collecting the treatment liquid from the chamber.

In another aspect of this disclosure, there is provided an improved treatment-liquid application device including a treatment-liquid application unit including a chamber to store a treatment liquid and applying the treatment liquid from the chamber to an application target; a treatment-liquid storage unit to store the treatment liquid to be supplied to the chamber; a supply channel member forming a supply channel to supply the treatment liquid from the treatment-liquid storage unit to the chamber; a collection channel member forming a collection channel to collect the treatment liquid from the chamber; and a temporary storage portion disposed in the collection channel to temporarily store the treatment liquid collected through the collection channel member and resupplied to the chamber. The temporary storage portion has an internal horizontal cross-sectional area greater than a channel cross-sectional area of the collection channel. The collection channel member has a first channel portion of a channel cross-sectional area smaller than the internal horizontal cross-sectional area of the temporary storage portion. A liquid level of the treatment liquid in the collection channel is maintained in the first channel portion after termination of a collecting operation for collecting the treatment liquid from the chamber.

BRIEF DESCRIPTION OF THE DRAWINGS

The aforementioned and other aspects, features, and advantages will be better understood by reference to the following detailed description when considered in connection with the accompanying drawings, wherein.

Figure 1:
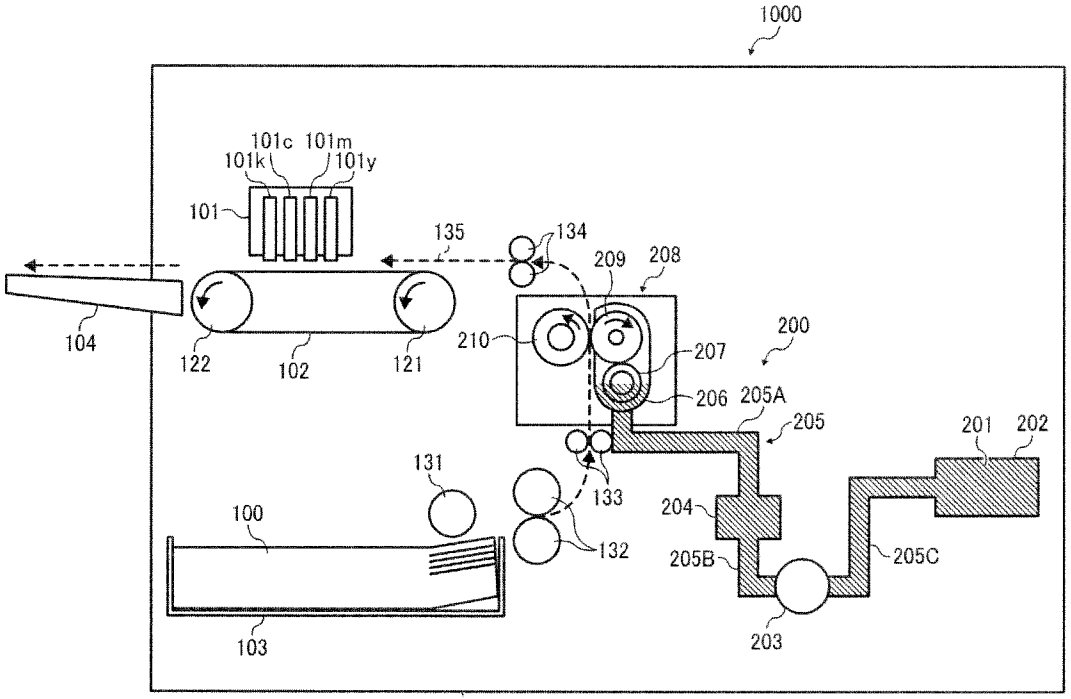
FIG. 1 is a schematic view of an image forming apparatus according to an exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In this disclosure, the term "image forming apparatus" refers to an apparatus (e.g., liquid ejection apparatus or droplet ejection apparatus) that ejects ink or any other liquid on an image recording medium to form an image on the image recording medium. The medium is made of, for example, paper, string, fiber, cloth, leather, metal, plastic, glass, timber, and ceramic. The term "image formation", which is used herein as a synonym for "image recording" and "image printing", includes applying not only meaningful images such as characters and figures but meaningless images such as patterns to the image recording medium (e.g., simply landing liquid droplets onto the image recording medium). The term "liquid" used herein is not limited to "ink" in a narrow sense and includes anything ejected in the form of liquid, such as a DNA sample, resist, pattern material, washing fluid, storing solution, and fixing solution. The term "image" used herein is not limited to a two-dimensional image and includes, for example, an image applied to a three dimensional object and a three dimensional object itself formed as a three-dimensionally molded image. In the following description, an image forming apparatus is described taking an example of a liquid-ejection-type image forming apparatus. It is to be noted that the term "image forming apparatus" used herein is not limited to such a liquid-ejection-type image forming apparatus and may be, e.g., an electrophotographic image forming apparatus.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an image forming apparatus 1000 according to an exemplary embodiment of the present disclosure is described with reference to FIG. 1.

FIG. 1 is a schematic view of the image forming apparatus 1000 according to this exemplary embodiment. In FIG. 1, the image forming apparatus 1000 includes a recording head unit 101 serving as an image forming unit to eject liquid droplets toward a sheet 100 serving as an image recording medium to form an image, a conveyance belt 102 to convey the sheet 100, a sheet feed tray 103 to store the sheet 100, and a treatment-liquid application device 200 to apply treatment liquid to an application target, e.g., the sheet 100 on an upstream side from the recording head unit 101 in a direction (hereinafter, sheet transport direction) in which the sheet 100 is transported in the image forming apparatus 1000.

In FIG. 1, the recording head unit 101 includes recording heads 101*y*, 101*m*, 101*c*, and 101*k* serving as line-type liquid ejection heads to eject ink droplets of yellow (y), magenta (m), cyan (c), and black (k), respectively. Each recording head 101 has at least one nozzle row including multiple nozzles through which ink droplets are ejected. In each nozzle row, the multiple nozzles are arrayed within a range corresponding to, e.g., a maximum width of available recording media. Alternatively, the image forming apparatus may be a serial-type image forming apparatus in which such a recording head unit is mounted on a movable carriage.

The conveyance belt 102 is an endless belt looped between a conveyance roller 121 and a tension roller 122 so as to circulate in a belt conveyance direction. The sheet 100 may be retained on the conveyance belt 102 by electrostatic attraction, air aspiration, or any other method. For example, the sheet 100 may be conveyed by a conveyance unit including a pair of rollers.

From a stack of sheets 100 stored in the sheet feed tray 103, the sheet 100 is separated by a pick-up roller 131 and fed by a pair of transport rollers 132 to a pair of registration rollers 133. The pair of registration rollers 133 feeds the sheet 100 to the treatment-liquid application device 200, and the treatment-liquid application device 200 applies treatment liquid to the sheet 100. The sheet 100 applied with treatment liquid is fed by a pair of transport rollers 134 onto the conveyance belt 102 via a transport passage 135. Thus, the sheet 100 is retained on the conveyance belt 102. The sheet 100 is conveyed by the circulation of the conveyance belt 102 to a position below the recording head unit 101. Then, the recording head unit 101 ejects droplets of respective color inks to form a desired image on the sheet 100. The sheet 100 with the image formed is discharged to an output tray 104.

As illustrated in FIG. 1, the treatment-liquid application device 200 includes, for example, a deformable treatment-liquid container 202 serving as a treatment-liquid storage unit, e.g., a bag of polyethylene terephthalate (PET) film, to store treatment liquid 201, a pump 203 to deliver with pressure the treatment liquid 201 supplied from the treatment-liquid container 202, and an application unit 208 serving as a treatment-liquid application unit to apply the treatment liquid 201 to the sheet 100. In preparation for application, the treatment liquid 201 in the treatment-liquid container 202 is pumped up by the pump 203 and delivered to a chamber 206 of the application unit 208 through a liquid channel 205 serving as a supply channel formed in a tube.

As illustrated in FIG. 1, the application unit 208 includes, for example, a feed roller 210 to feed the sheet 100, an application roller 209 opposing the feed roller 210 to apply the treatment liquid 201 to the sheet 100, and a squeeze roller 207 to supply the treatment liquid 201 to the application roller 209 and form a liquid thin film of the treatment liquid 201 on the application roller 209. The application roller 209 contacts the feed roller 210, and the squeeze roller 207 contacts the application roller 209. The treatment liquid 201 supplied by the rotation of the squeeze roller 207 and the application roller 209 is formed as a liquid film layer on the application roller 209 and applied to the sheet 100 sandwiched between the application roller 209 and the feed roller 210 by the rotation of the application roller 209.

In the present exemplary embodiment, the treatment liquid 201 is a modifier applied to a surface of the sheet 100 to modify the surface of the sheet 100. For example, the treatment liquid 201 may be a fixing agent (setting agent) that is uniformly applied over the sheet 100 before image formation to cause the moisture of ink to promptly penetrate into the sheet 100, increase the viscosity of color components, and the drying speed of ink, thus preventing feathering, bleeding, and/or offset of ink and enhancing the productivity (e.g., the number of image outputs per unit time). Regarding the composition, for example, the treatment liquid 201 may be a solution containing a surface acting agent (for example, an anionic, cationic, or nonionic agent or a mixed agent including two or more of the foregoing types), a cellulosic material (e.g., hydroxypropyl cellulose) for facilitating the penetration of moisture, and a base material such as talc powder. Further, the solution may contain fine particles.

In the present exemplary embodiment, when a predetermined time has elapsed after the termination of application of the treatment liquid 201, the treatment liquid 201 in the chamber 206 is collected using the pump 203 toward the treatment-liquid container 202 through the liquid channel 205 serving as a collection channel. In the present exemplary embodiment, the liquid channel 205 serves as both the supply channel and the collection channel and includes a temporary storage portion 204 having a channel cross-sectional area (an area of a channel cross section having a transport direction of the treatment liquid as a normal line direction) enough to prevent a meniscus of the treatment liquid 201 from being maintained therein. The liquid channel 205 includes, for example, a first channel portion 205A to connect the chamber 206 to the temporary storage portion 204, a second channel portion 205B to connect the temporary storage portion 204 to the pump 203, and a third channel portion 205C to connect the pump 203 to the treatment-liquid container 202. The channel cross-sectional area of any other channel portion of the liquid channel 205 except for the temporary storage portion 204 is set to a size capable of maintaining the meniscus of the treatment liquid 201 therein. Such a configuration allows the treatment liquid 201 to be delivered in any of the directions for collecting and supplying the treatment liquid 201 by suctioning operation and feeding operation of the pump 203.

In the collecting operation, air may enter the temporary storage portion 204 from the chamber 206 along with the treatment liquid 201, and the temporary storage portion 204 separates the air from the treatment liquid 201. In the present exemplary embodiment, when the treatment liquid 201 collected with air from the chamber 206 enters the temporary storage portion 204, the collected treatment liquid 201 drops into the treatment liquid 201 temporarily stored in the temporary storage portion 204 or moves along an internal wall face of the temporary storage portion 204 to be incorporated into the treatment liquid 201 the treatment liquid 201 temporarily stored in the temporary storage portion 204. Meanwhile, the air collected with the treatment liquid 201 is integrated with air in the temporary storage portion 204.

In the present exemplary embodiment, by continuing the collecting operation, more air gets stored in the temporary storage portion 204. When a predetermined amount of air is stored in the temporary storage portion 204, the collecting operation is terminated. Such collecting operation prevents the treatment liquid including air from entering the second channel portion 205B connected to a lower portion (in the present exemplary embodiment, a bottom face) of the temporary storage portion 204. Accordingly, the above-described configuration prevents improper liquid-sending operation of the pump 203 caused by air entering the second channel portion 205B.

In the present exemplary embodiment, since the treatment-liquid container 202 is a flexible bag-type container capable of changing the capacity thereof by the suctioning operation of the pump 203. Consequently, if air enters the treatment-liquid container 202, the treatment liquid might not be suctioned from the treatment-liquid container 202 by the suctioning operation of the pump 203. In addition, if air enters the treatment-liquid container 202, the treatment-liquid container 202 might not be properly reduced to the minimum capacity. By contrast, the above-described configuration of the present exemplary embodiment properly prevents air from entering the treatment-liquid container 202, thus preventing such failures.

When the collecting operation is terminated, in the present exemplary embodiment, the temporary storage portion 204 becomes fully filled with the treatment liquid 201 and the treatment-liquid application device 200 goes to a standby state. At the standby state, the liquid level of the treatment liquid 201 is maintained within the first channel portion 205A. For such a configuration, the area at which the liquid level of the treatment liquid 201 contacts air is smaller than a case in which the liquid level of the treatment liquid 201 is maintained within the temporary storage portion 204. Thus, failures caused by evaporation, such as waste or change in properties of the treatment liquid, can be minimized.

Next, the configuration and operation of the present exemplary embodiment are described below in more details.

Figure 2:
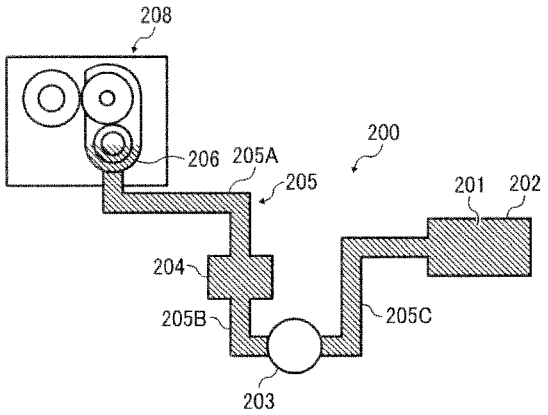
FIG. 2 is a schematic view of a treatment-liquid application device in the image forming apparatus.
Figure 3:
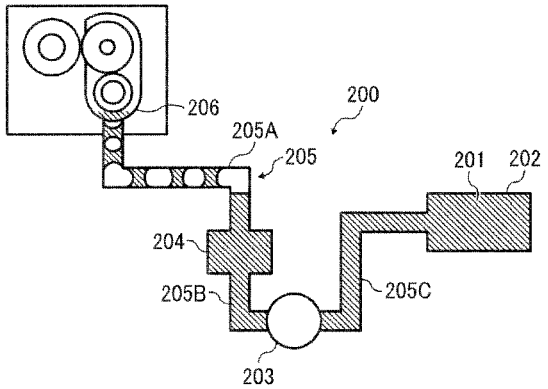
FIG. 3 is a schematic view of the treatment-liquid application device at a state in which collecting operation of a treatment liquid is performed.

FIG. 2 is a schematic view of a configuration of the treatment-liquid application device 200 according to the present exemplary embodiment. As described above, when a predetermined time has passed after the termination of the application operation, the treatment liquid 201 of the chamber 206 is collected toward the treatment-liquid container 202 through the liquid channel 205 by the suctioning operation of the pump 203 capable of bidirectionally delivering the treatment liquid 201. In the collecting operation, when the chamber 206 is sufficiently filled with the treatment liquid 201, only the treatment liquid 201 is collected without collecting air. However, as the amount of the treatment liquid 201 gradually decreases by continuing the collecting operation, not only the treatment liquid but also air enters the first channel portion 205A. At that time, the treatment liquid 201 in the first channel portion 205A forms menisci as illustrated in FIG. 3. As a result, air collected with the treatment liquid 201 cannot reach the chamber 206 through the first channel portion 205.

Figure 4:
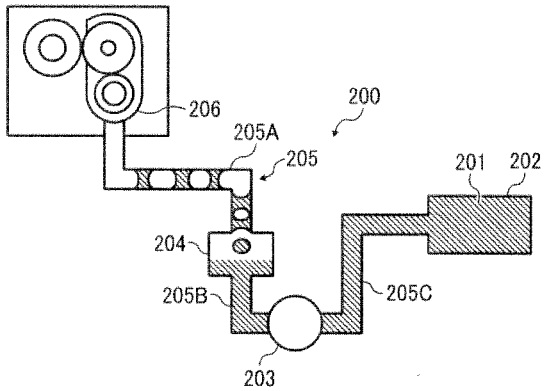
FIG. 4 is a schematic view of the treatment-liquid application device at a state in which the treatment liquid including menisci reaches a temporary storage portion along with air.

When the treatment liquid 201 collected with air and forming menisci enters the temporary storage portion 204 from the first channel portion 205A, the surface tension of the treatment liquid 201 for maintaining the menisci is lost. As a result, as illustrated in FIG. 4, the treatment liquid 201 drops or moves along an inner wall face of the temporary storage portion 204 into the treatment liquid stored in the temporary storage portion 204, and the air collected with the treatment liquid 201 is integrated with air stored in the temporary storage portion 204. Accordingly, air is separated from the liquid in the temporary storage portion 204. Thus, in the present exemplary embodiment, air collected with the treatment liquid 201 can be separated from the treatment liquid 201 in the temporary storage portion 204, preventing failures otherwise caused by the air collected with the treatment liquid 201.

Figure 5:
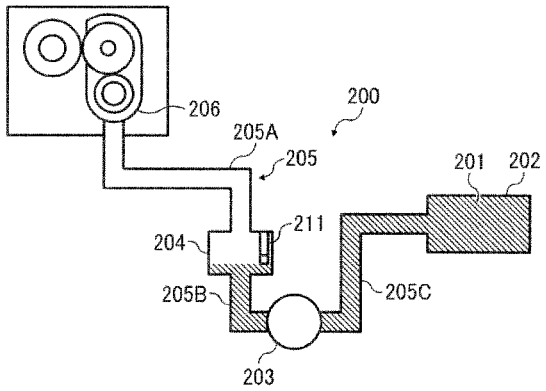
FIG. 5 is a schematic view of the treatment-liquid application device including a liquid-level detector to detect the height of a liquid level of the treatment liquid in the temporary storage portion.

FIG. 5 is a schematic view of the treatment-liquid application device 200 including a liquid-level detector 211 to detect the height of a liquid level of the treatment liquid 201 in the temporary storage portion 204.

The amount of air in the temporary storage portion 204 increases with the collecting operation. In the present exemplary embodiment, the temporary storage portion 204 has a capacity greater than an estimated maximum amount of air entering the temporary storage portion 204 from the first channel portion 205A when the treatment liquid 201 of the chamber 206 is all collected. The estimated maximum amount of air is obtained from the suction amount of the pump 203 in the collecting operation and the amount of the treatment liquid 201 maintained in the chamber 206 and the first channel portion 205A. Preferably, the estimated maximum amount of air is greater than the suction amount of the pump 203 in the collecting operation. For such a configuration, a state in which the temporary storage portion 204 is filled with air means a state in which all the treatment liquid of the chamber 206 has been collected. In the present exemplary embodiment, the amount of air in the temporary storage portion 204 increases with the collecting operation. When the liquid level of the treatment liquid 201 in the temporary storage portion 204 goes down to a predetermined height, the liquid-level detector 211 detects the height. Receiving the detection result from the liquid-level detector 211, a controller stops the suctioning operation of the pump 203, thus terminating the collecting operation.

After the termination of the collecting operation, in the present exemplary embodiment, as described above, the temporary storage portion 204 gets fully filled with the treatment liquid 201. Then, the liquid level of the treatment liquid 201 is maintained within the first channel portion 205A, and the treatment-liquid application device 200 transits to the standby state.

For example, the transition to the standby state is performed as follows. The liquid-sending operation of the pump 203 is performed to send the treatment liquid 201 into the temporary storage portion 204 by the power of the pump 203 and maintain the liquid level of the treatment liquid 201 at a position within the first channel portion 205A. Then, a valve of the pump 203 is closed to maintain the position of the liquid level of the treatment liquid 201.

Figure 6:
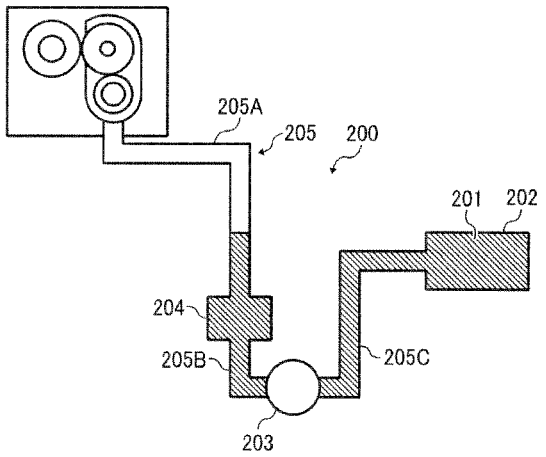
FIG. 6 is a schematic view of relative positions of the temporary storage portion and a treatment-liquid container useable in the treatment-liquid application device.

Alternatively, for example, as illustrated in FIG. 6, the treatment-liquid container 202 is disposed higher than a first opening of the temporary storage portion 204 connected to the first channel portion 205A. After the termination of the collecting operation, the pump 203 is opened to connect the second channel portion 205B to the third channel portion 205C. In this method, by opening the pump 203, the liquid level of the treatment liquid 201 in the temporary storage portion 204 is raised to and maintained at a position within the first channel portion 205A by a difference between the liquid level of the treatment liquid 201 in the treatment-liquid container 202 and it. Accordingly, the pump 203 need not have an additional valve for shutting the flow of the treatment liquid or maintaining the position of the liquid level of the treatment liquid 201, thus resulting in a simplified configuration and cost reduction. In addition, such a method obviates control operation and power consumption at the standby state. As the pump 203 useable in this method, for example, a tubing pump capable of delivering liquid bidirectionally may be used. It is to be noted that the ump 203 is not limited to such a tubing pump and may be any other suitable pump.

Figure 7:
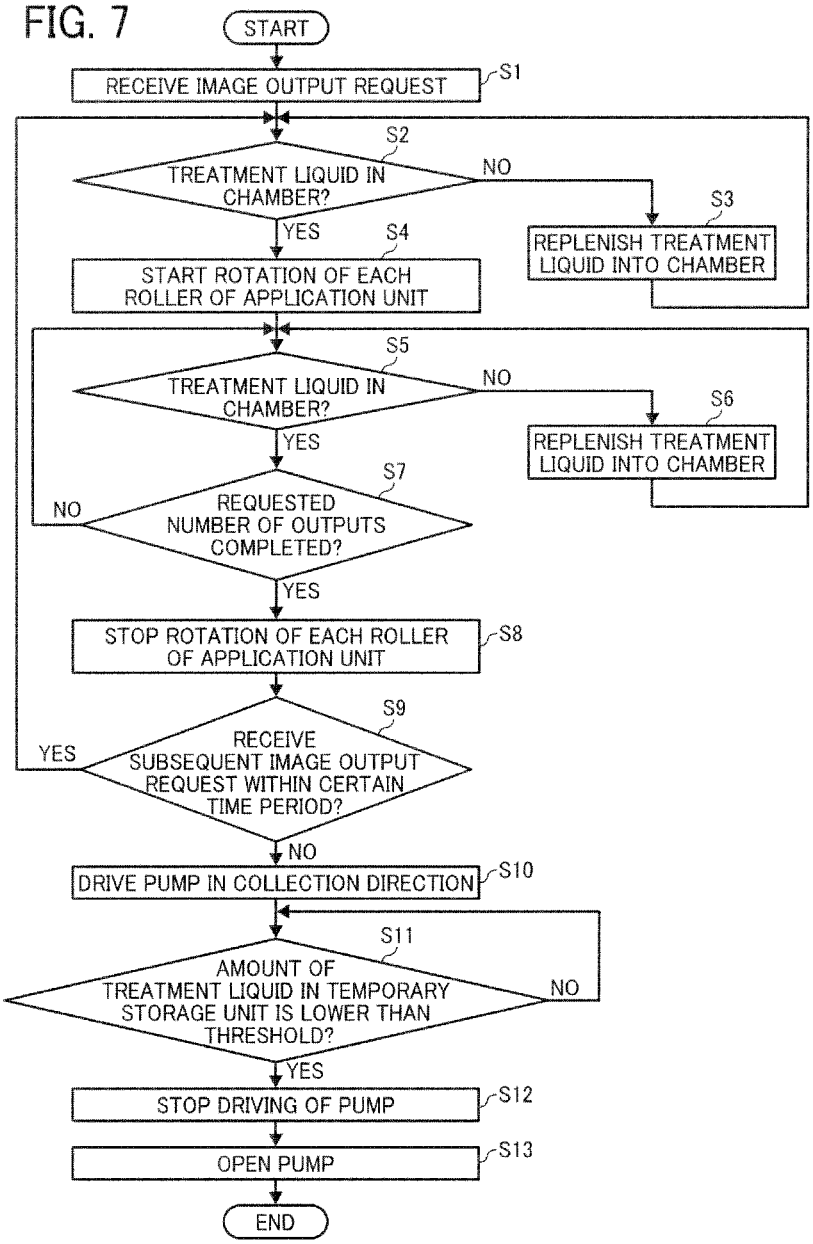
FIG. 7 is a flowchart of a procedure of collecting operation of the treatment liquid.

FIG. 7 is a flowchart of a procedure of the collecting operation of treatment liquid according to an exemplary embodiment.

The flowchart of FIG. 7 shows the collecting operation performed in the configuration illustrated in FIG. 6. When an image output request is received at S1, it is determined at S2 whether or not the amount of the treatment liquid 201 in the chamber 206 is at a predetermined amount or more. If the amount of the treatment liquid 201 in the chamber 206 is lower than the predetermined amount ("NO" at S2), at S3 the pump 203 performs the sending operation to replenish the treatment liquid 201 from the treatment-liquid container 202 to the chamber 206. At S4, the squeeze roller 207, the application roller 209, and the feed roller 210 of the application unit 208 are rotated to supply the treatment liquid to a pressure area between the squeeze roller 207 and the application roller 209 and spread the supplied treatment liquid at the pressure area to form a thin film of the treatment liquid on the application roller 209 in preparation for application. When a sheet is transported into the application unit 208, the film of treatment liquid formed on the application roller 209 is transferred onto the sheet. Thus, the treatment liquid is applied to the sheet.

At S5, it is determined whether or not the amount of the treatment liquid 201 in the chamber 206 is at a predetermined amount or more. If the amount of the treatment liquid 201 in the chamber 206 is lower than the predetermined amount ("NO" at S5), at S6 the pump 203 performs the sending operation to replenish the treatment liquid 201 from the treatment-liquid container 202 to the chamber 206. If "YES" at S5, it is determined at S7 whether or not a requested number of images in the image output request has been outputted. If "NO" at S7, the operation of S5 is repeated until the requested number of image output has been completed. If "YES" at S7, the rotation of each of the squeeze roller 207, the application roller 209, and the feed roller 210 is stopped at S8. If the next image output (treatment-liquid application) request is received within a predetermined period of time ("YES" at S9), the above-described S2 and subsequent steps are repeated. By contrast, if the next image output (treatment-liquid application) request is not received within a predetermined period of time ("NO" at S9), the process goes to the collecting operation to collect the treatment liquid from the chamber 206.

In the collecting operation, at S10 the pump 203 suctions the treatment liquid 201 in the collecting direction in which the treatment liquid 201 is delivered toward the treatment-liquid container 202. In accordance with a detection result of the liquid-level detector 211 illustrated in FIG. 5, at S11 it is determined whether or not the amount of the treatment liquid 201 in the temporary storage portion 204 is lower than a predetermined amount. If the amount of the treatment liquid 201 in the temporary storage portion 204 is lower than the predetermined amount ("YES" at S11), at S12 the pump 203 is stopped. At S13, the pump 203 is opened. Thus, the second channel portion 205B is connected to the third channel portion 205C. As a result, the liquid level of the treatment liquid 201 in the temporary storage portion 204 is raised to and maintained at a position within the first channel portion 205A by a difference between the liquid level of the treatment liquid 201 in the treatment-liquid container 202 and it, and the process goes to the standby state.

[Variation 1] Next, one variation (hereinafter, Variation 1) of the treatment-liquid application device 200 is described below.

Figure 8:
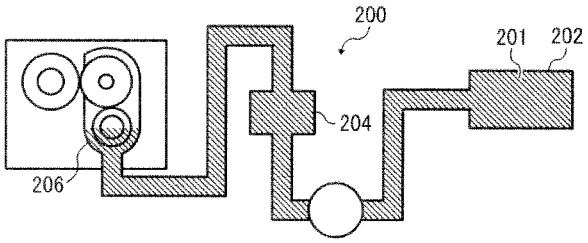
FIG. 8 is a schematic view of a configuration of Variation 1 at a state in which a treatment liquid is supplied to a chamber.
Figure 9:
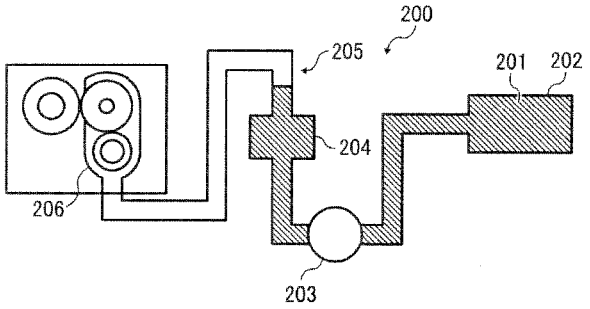
FIG. 9 is a schematic view of the configuration of Variation 1 at a state in which the treatment liquid is collected from the chamber.

FIG. 8 is a schematic view of Variation 1 at a state in which the treatment liquid 201 is supplied to the chamber 206. FIG. 9 is a schematic view of Variation 1 at a state in which the treatment liquid 201 is collected from the chamber 206.

In Variation 1, the treatment-liquid container 202 and the temporary storage portion 204 are disposed higher than a bottom portion of the chamber 206. Meanwhile, the treatment-liquid container 202 is disposed higher than the first opening of the temporary storage portion 204 connected to the first channel portion 205A, which is the same as the above-described exemplary embodiment illustrated in FIG. 6. Accordingly, in Variation 1, by opening the pump 203, as illustrated in FIG. 9, the liquid level of the treatment liquid 201 in the temporary storage portion 204 is raised to and maintained at a position within the first channel portion 205A by a difference between the liquid level of the treatment liquid 201 in the treatment-liquid container 202 and it. Thus, as with the configuration of the above-described exemplary embodiment illustrated in FIG. 6, the configuration of Variation 1 can provide a simplified configuration of the pump 203 at a reduced cost and obviate control operation and power consumption at the standby state.

Figure 10:
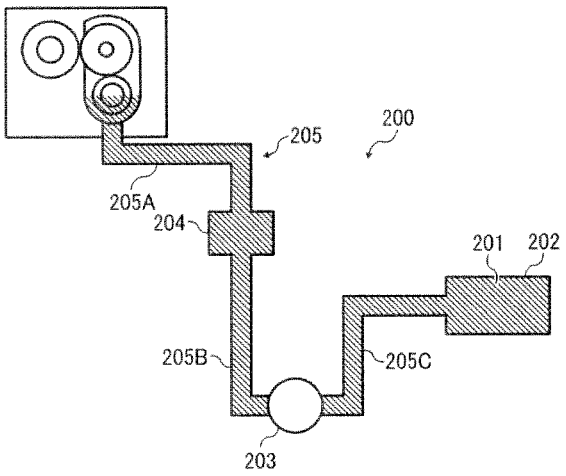
FIG. 10 is a schematic view of a configuration of Variation 2 at a state in which a treatment liquid is supplied to a chamber.
Figure 11:
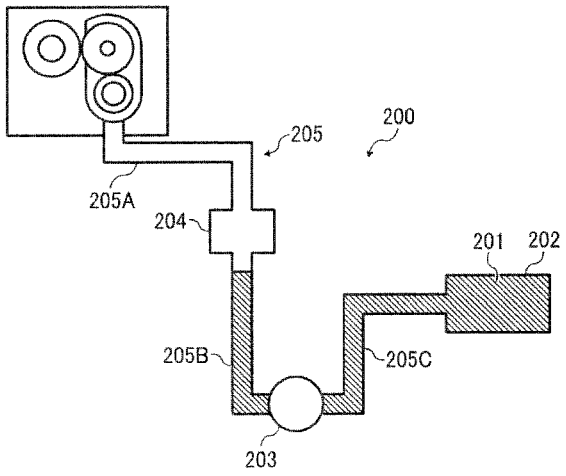
FIG. 11 is a schematic view of the configuration of Variation 2 at a state in which the treatment liquid is collected from the chamber.

[Variation 2] Next, another variation (hereinafter, Variation 2) of the treatment-liquid application device 200 is described below. FIG. 10 is a schematic view of Variation 2 at a state in which the treatment liquid 201 is supplied to the chamber 206. FIG. 11 is a schematic view of Variation 2 at a state in which the treatment liquid 201 is collected from the chamber 206. In Variation 2, the treatment-liquid container 202 is disposed lower than a second opening (in Variation 2, at a bottom face) of the temporary storage portion 204 connected to the second channel portion 205B. In such a case, by opening the pump 203 after the termination of collecting operation, as illustrated in FIG. 11, the liquid level of the treatment liquid 201 in the temporary storage portion 204 goes down to a position within the second channel portion 205B by a difference between the liquid level of the treatment liquid 201 in the treatment-liquid container 202 and it. Thus, as with the configurations of the above-described exemplary embodiment illustrated in FIG. 6 and Variation 1, the configuration of Variation 2 can provide a simplified configuration of the pump 203 at a reduced cost and obviate control operation and power consumption at the standby state.

As described above, the image forming apparatus according to the present exemplary embodiment (including the above-described variations) applies the treatment liquid to the sheet 100 serving as an image recording medium before image formation, and forms an image on the sheet 100 applied with the treatment liquid. The image forming apparatus includes the application unit 208 serving as a treatment-liquid application unit to apply the treatment liquid 201 from the chamber 206 to the sheet 100; the treatment-liquid container 202 serving as a treatment-liquid storage unit to store the treatment liquid 201 to be supplied to the chamber 206; the tube serving as both a supply channel member and a collection channel member that forms the liquid channel 205 serving as both a supply channel to supply the treatment liquid 201 from the treatment-liquid container 202 to the chamber 206 and a collection channel to collect the treatment liquid 201 from the chamber 206; and a temporary storage portion 204 disposed in the liquid channel 205 to temporarily store the treatment liquid 201 collected through the liquid channel 205 and having an internal horizontal cross-sectional area greater than a channel cross-sectional area of the collection channel. The treatment liquid 201 collected through the liquid channel 205 is resupplied to the chamber 206. In the image forming apparatus according to the present exemplary embodiment, each of the first channel portion 205A and the second channel portion 205B of the liquid channel 205 has a channel cross-sectional area smaller than the internal horizontal cross-sectional area of the temporary storage portion 204, and a liquid level of the treatment liquid 201 in the liquid channel 205 is maintained in the first channel portion 205A or the second channel portion 205B after termination of a collecting operation for collecting the treatment liquid 201 from the chamber 206 through the liquid channel 205. Such a configuration can reduce the area at which the treatment liquid 201 contacts ambient air as compared with a case in which the liquid level of the treatment liquid 201 is maintained within the temporary storage portion 204, thus minimizing failures, such as waste or change in properties of the treatment liquid. Further, in the above-described Variation 2, the bottom of the chamber 206 is disposed higher than the temporary storage portion 204. Such a configuration allows the treatment liquid in the chamber 206 to flow toward the temporary storage portion 204 by its weight when the pump 203 is opened. Accordingly, when the treatment liquid in the chamber 206 is collected to the temporary storage portion 204, all the treatment liquid in the chamber 206 can be collected to the temporary storage portion 204 even if the pump 203 is stopped before all the treatment liquid the chamber 206 is collected. As a result, the operation time of the pump 203 can be reduced, thus reducing power consumption. In the above-described exemplary embodiment and Variation 1, the liquid channel 205 connects the chamber 206 to the treatment-liquid container 202, the first channel portion 205A connects the chamber 206 to a first opening of the temporary storage portion 204, and the treatment-liquid container 202 is disposed higher than the first opening of the temporary storage portion 204 connected to the first channel portion 205A. For such an arrangement, by opening the pump 203, the liquid level of the treatment liquid in the temporary storage portion 204 is raised to and maintained at a portion within the first channel portion 205A by a difference between the liquid level of the treatment liquid in the treatment-liquid container 202 and it. Such a configuration can obviate adding to the pump 203 a valve function for shutting the flow of the treatment liquid or adding a valve for maintaining the position of the liquid level of the treatment liquid 201, thus obtaining a simplified configuration at a reduced cost. In addition, such a configuration can obviate control operation and power consumption at the standby state. Alternatively, in the present exemplary embodiment (including the above-described variations), the supply channel and the collection channel are at least partially formed with a common channel, i.e., the liquid channel 205, thus obtaining a more simplified configuration. Alternatively, the supply channel and the collection channel may be entirely separate channels. In the present exemplary embodiment (including the above-described variations), when the collecting operation is performed, the liquid level of the treatment liquid 201 is maintained within the temporary storage portion 204, thus allowing proper separation of air from the treatment liquid 201 in the temporary storage portion 204. In addition, in the present exemplary embodiment (including the above-described variations), after termination of the collecting operation, the liquid level of the treatment liquid 201 is maintained in a portion (i.e., the first channel portion 205A) of the liquid channel 205 disposed between the temporary storage portion 204 and the chamber 206. For such a configuration, in starting the next supply operation, the treatment liquid can be more promptly supplied to the chamber 206 than a case in which the liquid level of the treatment liquid 201 is maintained in a portion (i.e., the second channel portion 205B or the third channel portion 205C) of the liquid channel 205 disposed between the temporary storage portion 204 and the treatment-liquid container 202 after termination of the collecting operation. In the present exemplary embodiment (including the above-described variations), the pump 203 serving as a feed-force applicator to apply to the treatment liquid 201 a feed force toward the temporary storage portion 204 to collect the treatment liquid 201 from the chamber 206 through the liquid channel 205 is disposed downstream from the temporary storage portion 204 in a direction in which the treatment liquid 201 is collected from the chamber 206. Such a configuration prevents air bubbles from entering the pump 203, thus allowing accurate control of the feed amount of treatment liquid collected. In the present exemplary embodiment (including the above-described variations), the application unit 208 includes the application roller 209 to apply the treatment liquid 201 onto the sheet 100, the squeeze roller 207 to form a thin film on an outer circumferential surface of the application roller 209, and the treatment-liquid supply section to supply the treatment liquid 201 onto the outer circumferential surface of the squeeze roller 207. Such a configuration allows a desired amount of the treatment liquid to be applied to the sheet 100 with a simple configuration. As a treatment-liquid application device of the image forming apparatus according to the present exemplary embodiment (including the above-described variations), the treatment-liquid application device 200 includes the application unit 208 serving as a treatment-liquid application unit to apply the treatment liquid 201 stored in the chamber 206 to the sheet 100 serving as an application target; the treatment-liquid container 202 serving as a treatment-liquid storage unit to store the treatment liquid 201 to be supplied to the chamber 206; the tube serving as both a supply channel member and a collection channel member that forms the liquid channel 205 serving as both a supply channel to supply the treatment liquid 201 from the treatment-liquid container 202 to the chamber 206 and a collection channel to collect the treatment liquid 201 from the chamber 206; and a temporary storage portion 204 disposed in the liquid channel 205 to temporarily store the treatment liquid 201 collected through the liquid channel 205 and having an internal horizontal cross-sectional area greater than a channel cross-sectional area of the collection channel. The treatment liquid 201 collected through the liquid channel 205 is resupplied to the chamber 206. Each of the first channel portion 205A and the second channel portion 205B of the liquid channel 205 has a channel cross-sectional area smaller than the internal horizontal cross-sectional area of the temporary storage portion 204, and a liquid level of the treatment liquid 201 in the liquid channel 205 is maintained in the first channel portion 205A or the second channel portion 205B after termination of a collecting operation for collecting the treatment liquid 201 from the chamber 206 through the liquid channel 205. The treatment-liquid application device 200 may apply a treatment liquid to any other application target than the above-described image recording medium.

In the present exemplary embodiment, the treatment-liquid application device 200 applies the treatment liquid 201 before image formation. However, it is to be noted that the treatment-liquid application device is not limited to such a configuration. For example, the treatment liquid 201 may be applied after image formation. In such a case, the treatment liquid 201 may be, for example, a brightening agent to give a gloss to an image recording medium or a coagulant agent to react ink on an image recording medium to solidify ink. The image forming unit is not limited to the recording head unit 101 and may be, for example, an electrophotographic image forming unit. In such a case, the treatment-liquid application device is applicable to an application device that applies a fixing agent to an image recording medium to fix toner on the recording medium by chemical reaction.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus or forming an image on a recording medium, the apparatus comprising:

an image forming unit to form the image on the recording medium;

a treatment-liquid application unit including a chamber to store a treatment liquid and applying the treatment liquid from the chamber to the recording medium;

a treatment-liquid storage unit to store the treatment liquid to be supplied to the chamber;

a supply channel member forming a supply channel to supply the treatment liquid from the treatment-liquid storage unit o the chamber;

a collection channel member forming a collection channel to collect the treatment liquid from the chamber to the treatment-liquid storage unit, treatment liquid flowing through the collection channel in a liquid collection direction;

a temporary storage portion disposed in the collection channel to temporarily store he treatment liquid collected through the collection channel member and resupplied to the chamber, in a side view, the temporary storage portion having an extent in a width direction that is perpendicular to the liquid collection direction greater that of the collection channel, the collection channel including a first channel portion to connect the chamber to the temporary storage portion, and a second channel portion to connect the temporary storage portion to the treatment-liquid storage unit; and a pump disposed in the second channel portion to bi-directionally deliver the treatment liquid to the temporary storage portion and to the treatment-liquid storage unit, respectively, wherein the first channel portion of the collection channel, in the side view, has an extent in a width direction that is perpendicular to the liquid collection direction smaller than that of the temporary storage portion, and wherein the image forming apparatus shifts to a standby state after termination of a collecting operation for collecting the treatment liquid from the chamber to the treatment-liquid storage unit through the first channel portion. the temporary storage portion and the second channel portion, and in the standby state, the temporary storage portion is communicated with the first channel portion, and the temporary storage portion and the second channel portion are filled with the treatment liquid, a liquid surface of said treatment liquid being at a position within the first channel portion.

2. The image forming apparatus according to claim 1, wherein a bottom of the chamber is disposed higher than the temporary storage portion.

3. The image forming apparatus according to claim 1, wherein the first channel portion connects the chamber to an opening of the temporary storage portion, and the treatment-liquid storage unit is disposed higher than the opening e temporary storage portion.

4. The image forming apparatus according to claim 1, wherein the supply channel and the collection channel are at least partially a same channel.

5. The image forming apparatus according claim 1 wherein, when the collecting operation is performed, the liquid level of the treatment liquid is maintained in the temporary storage portion.

6. The image forming apparatus according to claim 1, wherein the treatment-liquid application unit includes an application roller to apply the treatment liquid onto the recording medium and a squeeze roller to receive the treatment liquid from the chamber and form a liquid film of the treatment liquid on an outer circumferential surface of the application roller.

7. A treatment-liquid application device comprising:

a treatment-liquid application unit including a chamber to store a treatment liquid and applying the treatment liquid from the chamber to an application target;

a treatment-liquid storage unit to store the treatment liquid to be supplied to the chamber;

a supply channel member forming a supply channel to supply the treatment liquid from the treatment-liquid storage unit to the chamber;

a collection channel member forming a collection channel to collect the treatment liquid from the chamber to the treatment-liquid storage unit, the treatment liquid flowing through the collection channel in a liquid collection direction;

a temporary storage portion disposed in the collection channel to temporarily store the treatment liquid collected through the collection channel member and resupplied to the chamber, in a side view, the temporary storage portion having an extent in a width direction that is perpendicular to the liquid collection direction greater than that of the collection channel, the collection channel including a first channel portion to connect the chamber to the temporary storage portion, and a second channel portion to connect the temporary storage portion to the treatment-liquid storage unit: and a pump disposed in the second channel portion to bi-directionally deliver the treatment liquid to the temporary storage portion and to the treatment-liquid storage unit, respectively, wherein the first channel portion of the collection channel, in the side view, has an extent in a width direction that is perpendicular to the liquid collection direction smaller than that of the temporary storage portion, and wherein the image forming apparatus shifts to a standby state after termination of a collecting operation for collecting the treatment liquid from the chamber to the treatment-liquid storage unit through the first channel portion, the temporary storage portion and the second channel portion, and in the standby state, the temporary storage portion is communicated with the first channel portion, and the temporary storage portion and the second channel portion are filled with the treatment liquid, a liquid surface of said treatment liquid being at a position within the first channel portion.

8. The image forming apparatus according to claim 1, wherein the treatment liquid stored in the treatment-liquid storage unit has a same constitution as that of the treatment liquid supplied to the chamber of the treatment-liquid application unit.

9. The image forming apparatus according to claim 1, wherein the treatment liquid collected from the chamber has a same constitution as that of the treatment liquid stored in the treatment-liquid storage unit.

10. The image forming apparatus according to claim 1, wherein when the temporary storage portion is filled with the treatment liquid, the liquid level of the treatment liquid is maintained within the first channel portion having an extent in the width direction that is smaller than that of the temporary storage portion.

11. The image forming pp us according to claim 1, wherein after collection of the treatment liquid is terminated, the liquid level of the treatment liquid changes from being within the temporary storage portion to being within the first channel portion and maintained within the first channel portion.

12. The image forming apparatus according to claim 1, further comprising a liquid level detector to detect a liquid level of the treatment liquid in the temporary storage portion, wherein when the liquid level of the treatment liquid collected in the temporary storage portion falls to a predetermined height, the liquid level detector detects the liquid level at said height and causes collection of the treatment liquid to stop and thereby terminate the collecting operation.

13. The treatment-liquid application device according to claim 7, further comprising a liquid level detector to detect a liquid level of the treatment liquid in the temporary storage portion, wherein when the liquid level of the treatment liquid collected in the temporary storage portion falls to a predetermined height, the liquid level detector detects the liquid level at said height and causes collection of the treatment liquid to stop and thereby terminate the collecting operation.

* * * * *